United States Patent [19]

Boettger

[11] Patent Number: 4,573,653

[45] Date of Patent: Mar. 4, 1986

[54] URINAL HOLDER FOR HOSPITAL OVERBED STAND AND THE LIKE

[76] Inventor: Conrad H. Boettger, P.O. Box 329, Hesston, Kans. 67062

[21] Appl. No.: 598,262

[22] Filed: Apr. 9, 1984

[51] Int. Cl.[4] ..... A47G 23/02

[52] U.S. Cl. ..... 248/153; 248/224.4; 248/311.2

[58] Field of Search ..... 248/146, 153, 311.2, 248/214, 215, 224.4

[56] References Cited

U.S. PATENT DOCUMENTS

| | | | |
|---|---|---|---|
| 1,137,583 | 4/1915 | Cox | 248/311.2 |
| 1,267,046 | 5/1918 | Beaird | 248/214 X |
| 1,345,252 | 6/1920 | Rubin | 248/311.2 X |
| 2,294,151 | 8/1942 | Wooten, Jr. et al. | 248/311.2 X |
| 2,451,923 | 10/1948 | Cox et al. | 248/311.2 X |

FOREIGN PATENT DOCUMENTS

| | | | |
|---|---|---|---|
| 351348 | 4/1922 | Switzerland | 248/311.2 |
| 169645 | 6/1934 | Switzerland | 248/311.2 |

*Primary Examiner*—J. Franklin Foss
*Assistant Examiner*—David L. Talbott
*Attorney, Agent, or Firm*—Schmidt, Johnson, Hovey & Williams

[57] ABSTRACT

An open framework holder for urinals in the nature of a rack is made primarily from a single, continuous stretch of wire, bent and formed to provide a base upon which the urinal rests, a urnial-retaining front having a clearance for the handle of the urinal and a urinal-embracing top shaped to present an upper, urinal-receiving opening. Hooks at the rear of the top are used to removably attach the holder to a wall or to a supporting standard of an over bed table. An abutment at the rear of the base engages the wall or the standard.

4 Claims, 6 Drawing Figures

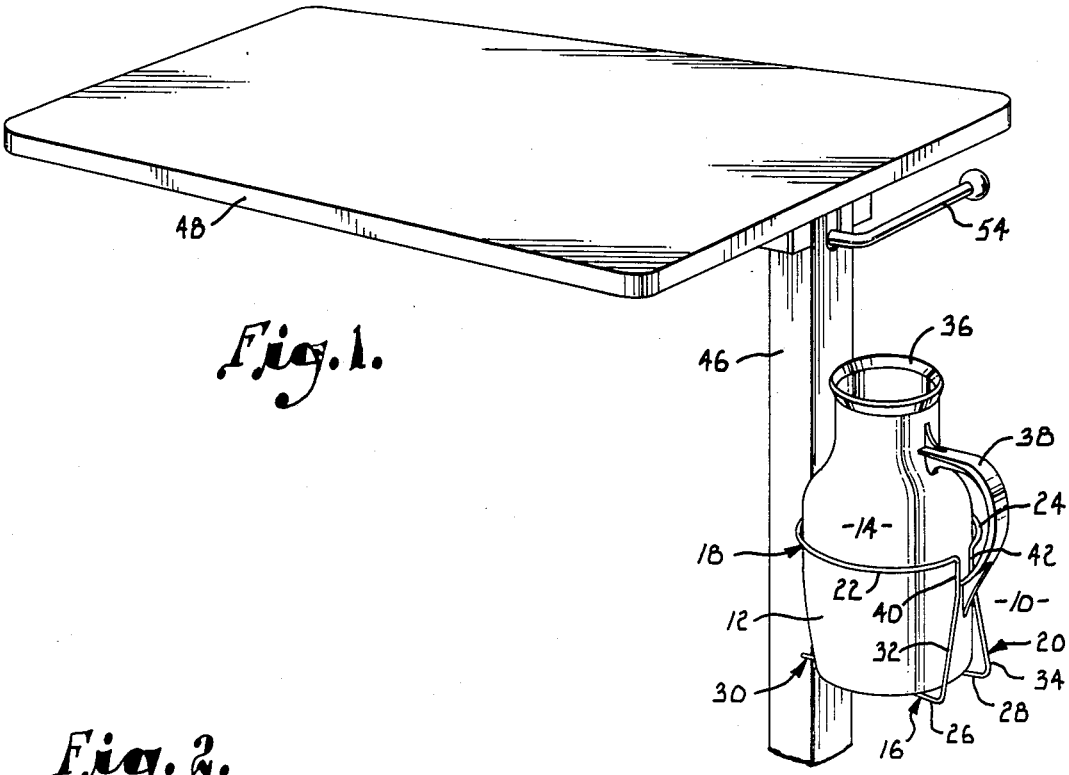
Fig. 1.
Fig. 2.
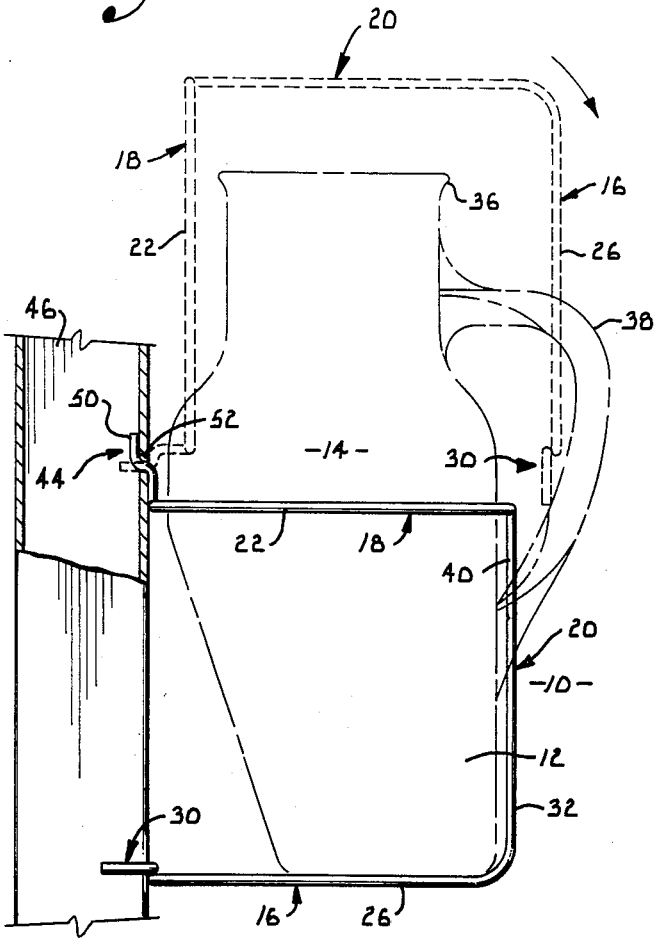
Fig. 3.
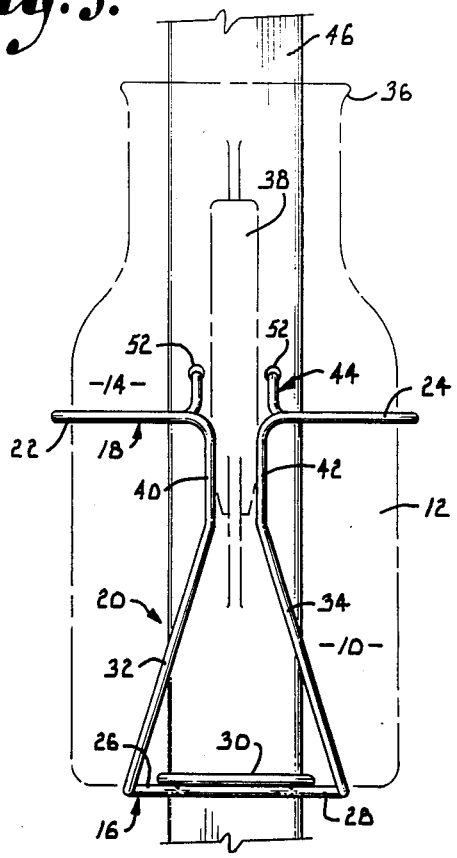

URINAL HOLDER FOR HOSPITAL OVERBED STAND AND THE LIKE

TECHNICAL FIELD

In most hospitals and other institutions for the reception, care, and medical treatment of the sick and wounded involving urinal dependent patients, there is normally no particular or suitable spot or area for location of the urinal itself when not in use. Oftentimes it is placed on an overbed stand, bedside cabinet or other unsatisfactory support such as to be readily accessible to the patient when needed. The resultant problem, because of congested and overcrowded conditions, is contamination especially when the urinal is accidentally knocked over or otherwise jarred or tilted with resultant spillage of some or all of its contents. Aside from inconvenience, the situation counteracts attempts to maintain proper sanitation and prevention of the spread of infectious diseases.

SUMMARY OF THE PRESENT INVENTION

The problem is solved by my invention which provides an inexpensive holder for the urinal to become an addition to the normal supply of equipment and materials by most hospitals and to be furnished in each sick room whenever needed as standard procedure. The holder is such as to permit location of the urinal where it is easily accessible to the patient, held against displacement and be quickly available for use by those who might otherwise have difficulty locating and handling the urinal for its intended purpose.

My holder is in the nature of a lightweight, yet strong and durable wire rack of open framework construction adapted for hanging on any one of a number of in-room supports at proper locations for the convenience of the patient and hospital personnel. It has a firm base upon which the urinal rests, an open top for easy removal and replacement of the urinal, and retention parts for precluding all possibility of tip over of the urinal or accidental spillage of the contents. The holder is, of itself, quite resistant to contamination but is removable from its support for cleansing as needed or desired. The construction is such as to expose the handle of the urinal where is can be easily and readily grasped to permit lifting of the urinal out of the holder and return without difficulty. Many other advantages and attributes of the instant invention will be made clear or become apparent as the following specification progresses.

IN THE DRAWINGS

FIG. 1 is a perspective view of a holder made according to my present invention showing a urinal in and on the same with holder mounted on the upright standard of a hospital overbed stand;

FIG. 2 is an enlarged side elevational view of the holder and the urinal (in phantom) with the holder on the standard and illustrating by dotted lines the movement of the holder during mounting;

FIG. 3 is a front view of the holder on the standard with the urinal shown in phantom;

DETAILED DESCRIPTION

Figure 4:
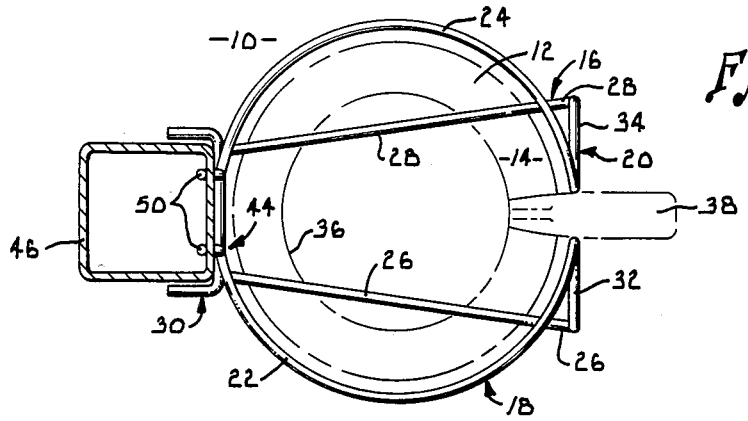
FIG. 4 is a top plan view of the holder on the standard with the urinal shown in phantom.

In FIGS. 1–4 and 6 a holder 10, in and on which a urinal 12 may be placed, is in the nature of an open framework, wire rack 14 made primarily from a relatively slender, continuous stretch of plastic or metalic material, such as stainless steel, having a uniform diameter throughout its length. The rack 14 includes a base 16 for supporting the urinal 12, a top 18 spaced above the base 16 for retaining the urinal 12 and a urinal-retaining front 20 integral with and interconnecting the base 16 and the top 18.

The top 18 has a pair of opposed, spaced apart, horizontally coplanar, arcuate sections 22 and 24 in looped relationship to the urinal 12 when the latter is resting on the base 16. The base 16 has a pair of straight, spaced apart, elongated, horizontally coplanar pieces 26 and 28 converging toward an attached abutment 30. The front 20 has a pair of straight, spaced apart, elongated, vertically coplanar members 32 and 34 diverging toward the base 16 and integral with the pieces 26 and 28 respectively.

The hollow urinal 12 has a lip 36 around its open top and a handle 38 for facilitating pouring or urine therefrom. Hence, the front 20 has a pair of straight, elongated, vertical elements 40 and 42 integral with sections 22 and 24 respectively and integral with the members 32 and 34 respectively. The elements 40 and 42 are coplanar with the members 32 and 34 and are horizontally spaced, presenting a clearance therebetween for the handle 38 when the urinal 12 is resting on the pieces 26 and 28, retained by the sections 22 and 24, the members 32 and 34 and the elements 40 and 42.

A mount 44 spaced rearwardly of the front 20 is provided in FIGS. 1–4 for attaching the top 18 to an upright standard 46 of a hospital overbed table 48. The mount 44 includes a generally S-shaped hook 50 on each section 22 and 24. A pair of spaced holes 52 is provided in the standard 46 for receiving the hooks 50, and the abutment 30, rigid to the pieces 26 and 28 at the apex of the base 16, is U-shaped for embracing the standard 46. The holes 52 are so located as to preclude interference by the holder 10 and the urinal 12 with a lever 54 for controlling the height of the table 48. As the standard 46 is raised and lowered, the holder 10 moves also and remains in the same position relative to the table 48.

Figure 5:
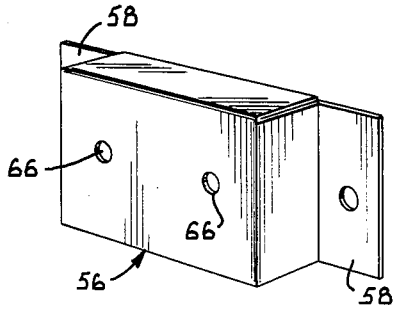
FIG. 5 is a perspective view of a bracket for mounting the holder on an upright taking the form of a wall surface.
Figure 6:
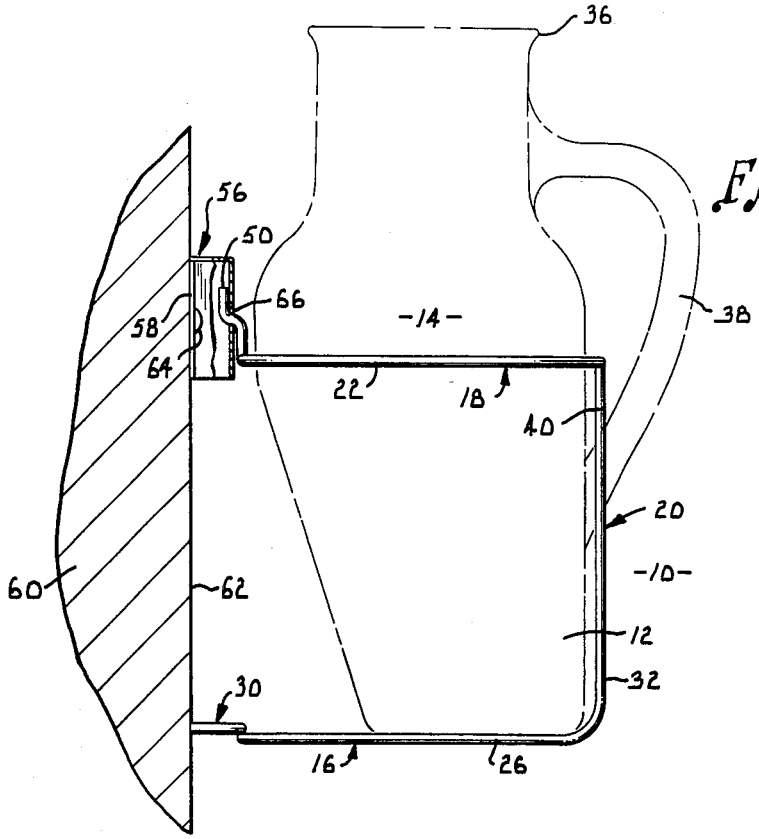
FIG. 6 is a view similar to FIG. 2 showing the use of the bracket illustrated in FIG. 5.

In FIGS. 5 and 6 there is shown a bracket 56 having wings 58 which may be attached to a wall 60 against its upright surface 62 by use of fasteners 64. The hooks 50 are received by holes 66 in the bracket 56 and the abutment 30 engages the surface 62.

The urinal 12 is easily removed from and returned to the holder 10 where it remains out of the way when not in use, not subject to accidental tip over yet always conveniently accessible. Sanitary conditions can be maintained, especially on the table 48 because the likelihood of contamination of food, medicines, utensils and other materials is virtually eliminated.

The support for the holder 10 can be easily and quickly provided by merely drilling the holes 52 in the standard 46 and/or fastening the bracket 56 to the wall 60. While the holder 10 is not easily soiled, it can also be easily and rapidly removed for storage or sanitizing purposes by tilting the holder 10 to a horizontal position and then to an inverted position as shown in FIG. 2. Holder 10 is quite strong and not likely to be damaged, and its replacement costs are quite minimal such that most hospitals can readily afford to maintain a sufficient supply for equipping each sick room or other areas with one or more of the holders 10 as needed or desired. And, of course, holder 10 is also adaptable for use in the home, in doctors' offices, in institutions other than hospitals, and elsewhere.

I claim:

1. In combination with an upright support having at least one transversely extending mounting hole therein and an abutment surface located below said hole, a detachable holder for urinal jugs and the like comprising:

an open framework, wire rack including a jug-supporting base, a jug-retaining top spaced above the base, and a jug-retaining front integral with and interconnecting the base and the top;

a mount spaced rearwardly of the front attaching the top to said upright; and an abutment on the base spaced below the mount and spaced rearwardly of the front in engagement with said surface, the top having a pair of opposed, spaced apart, horizontally coplanar, arcuate sections in looped relationship to the jug when the latter is resting on the base, said base having a pair of straight, spaced apart, elongated, horizontally coplanar pieces converging toward the abutment, said front having a pair of straight, spaced apart, elongated, vertically coplanar members diverging toward the base, said jug being provided with a handle, the front having a pair of straight, elongated, vertical elements integral with the top and with a corresponding member, coplanar with the members and horizontally spaced, presenting a clearance therebetween for the handle when the jug is resting on the base retained by the top, the members and the elements, said mount including at least one hook having a horizontal portion projecting rearwardly from said top into and through said hole and a vertical portion projecting upwardly from said horizontal portion at the rear extremity thereof for releasably retaining the hook engaged with said hole, said hook cooperating with said hole to hingedly attach said top of the rack to the support for swinging of the rack about a transverse, horizontal axis located adjacent said hole as the rack is attached to and detached from the support, said abutment bearing against said surface of the support and precluding further swinging of the rack about said axis.

2. The invention of claim 1, the wire for the rack being a relatively slender, continuous stretch of material having a uniform diameter through out its length.

3. The invention of claim 1, said support being an elongated standard, the abutment being U-shaped and embracing the standard when the top is attached to the standard by the mount.

4. The invention of claim 1, the mount including a pair of hooks integral with the top, there being a hook integral with each section respectively.

* * * * *